US011682854B2

(12) United States Patent
Yang et al.

(10) Patent No.: US 11,682,854 B2
(45) Date of Patent: Jun. 20, 2023

(54) BOARD CONNECTOR AND CONNECTOR ASSEMBLY

(71) Applicant: AMPHENOL ASSEMBLETECH (XIAMEN) CO., LTD., Fujian (CN)

(72) Inventors: Wenchu Yang, Fujian (CN); Weishun Chen, Fujian (CN); Zhenxing Liu, Fujian (CN); Hang Li, Fujian (CN)

(73) Assignee: AMPHENOL ASSEMBLETECH (XIAMEN) CO., LTD., Fujian (CN)

( * ) Notice: Subject to any disclaimer, the term of this patent is extended or adjusted under 35 U.S.C. 154(b) by 48 days.

(21) Appl. No.: 17/405,375

(22) Filed: Aug. 18, 2021

(65) Prior Publication Data

US 2022/0059957 A1 Feb. 24, 2022

(30) Foreign Application Priority Data

Aug. 21, 2020 (CN) ..... 202021771438.7
Aug. 21, 2020 (CN) ..... 202021773342.4

(51) Int. Cl.
*H01R 12/72* (2011.01)
*H01R 12/70* (2011.01)

(52) U.S. Cl.
CPC ..... *H01R 12/721* (2013.01); *H01R 12/7005* (2013.01); *H01R 12/727* (2013.01)

(58) Field of Classification Search
CPC ..... H01R 12/721; H01R 12/7005; H01R 12/727; H01R 13/64; H01R 13/6658; H01R 13/651
USPC ..... 439/637
See application file for complete search history.

(56) References Cited

U.S. PATENT DOCUMENTS 6,364,700 B1 * 4/2002 Zhu ..... H01R 13/6594 439/567
6,585,536 B1 * 7/2003 Wu ..... H01R 13/6275 439/358
6,793,531 B1 * 9/2004 Zhang ..... H01R 13/506 439/607.04
6,830,472 B1 * 12/2004 Wu ..... H01R 13/6275 439/352

(Continued)

FOREIGN PATENT DOCUMENTS

CN 206789805 U 12/2017
CN 209561681 U * 10/2019 ..... H01R 13/40

(Continued)

*Primary Examiner* — Peter G Leigh
(74) *Attorney, Agent, or Firm* — Browdy and Neimark, P.L.L.C.

(57) ABSTRACT

Disclosed is a board connector including a board connector body, conductive terminals of upper and lower rows inserted inside the board connector body and a docking housing wrapped outside the board connector body, wherein a front end of the board connector is used for docking with a cable connector, the docking housing including a top wall, a bottom wall and two side walls, a docking slot is provided between the top wall and a top surface of the board connector body, and the bottom wall is provided with a blocking element that protrudes downward. As compared with the prior art, interference may occur between a front end of a blocking element and a front end of a cable connector when the cable connector is reversely inserted, thereby preventing occurrence of a reverse inserting phenomenon.

17 Claims, 14 Drawing Sheets

(56) References Cited

U.S. PATENT DOCUMENTS 6,890,205 B1 * 5/2005 Wu ..... H01R 13/6275 439/906
7,086,901 B2 * 8/2006 Zhang ..... H01R 13/6582 439/541.5
7,744,402 B2 * 6/2010 Wu ..... H01R 12/592 439/470
8,961,235 B2 * 2/2015 Little ..... H01R 13/64 439/660
10,141,697 B2 * 11/2018 Wang ..... H01R 13/6581
10,797,450 B2 * 10/2020 Chen ..... H01R 13/6581
2004/0180577 A1 * 9/2004 Zhang ..... H01R 13/6594 439/607.04
2005/0048839 A1 * 3/2005 Zhang ..... H01R 12/716 439/607.56
2009/0305530 A1 * 12/2009 Ito ..... H01R 13/447 439/80
2010/0267261 A1 * 10/2010 Lin ..... H01R 13/6461 439/218
2016/0329662 A1 * 11/2016 Chen ..... H01R 12/724
2017/0062976 A1 * 3/2017 Little ..... H01R 13/6582
2017/0352970 A1 * 12/2017 Liang ..... H01R 12/7052
2018/0062323 A1 * 3/2018 Kirk ..... H01R 13/6594
2018/0205177 A1 * 7/2018 Zhou ..... H01R 13/6594
2018/0269607 A1 * 9/2018 Wu ..... H01R 12/79
2019/0067854 A1 * 2/2019 Ju ..... H01R 13/46
2019/0173232 A1 * 6/2019 Lu ..... H01R 13/6594
2019/0221973 A1 * 7/2019 Kirk ..... H01R 13/6585
2020/0203865 A1 * 6/2020 Wu ..... H01R 13/506

FOREIGN PATENT DOCUMENTS

CN 209561681 U 10/2019
CN 210156592 * 3/2020 ..... H01R 13/40
CN 210723480 U * 6/2020 ..... H01R 12/71
JP 2004207248 A * 7/2004 ..... H01R 12/72

* cited by examiner

BOARD CONNECTOR AND CONNECTOR ASSEMBLY

FIELD OF TECHNOLOGY

The disclosure relates to the technical field of connectors, in particular, relates to a board connector and a connector assembly.

BACKGROUND

In the prior art, the connector assembly mainly comprises a cable connector and a board connector mated with the cable connector. The cable connector mainly comprises an insulating body, a PCB board fixed on the insulating body, and a cable having one end electrically connected to the PCB board and extending outside the insulating body, the insulating body being provided with a latch. The board connector comprises a board connector body, conductive terminals of upper and lower rows inserted inside the board connector body, and a metal case wrapped outside the board connector body, the metal case being provided with a bayonet.

A correct process for docking a connector with a connector female seat involves: the PCB board of the cable connector is inserted forward into an opening of the board connector body of the board connector until the PCB board is clamped between the conductive terminals; a metal contact sheet of a front end of the PCB board is electrically connected to the conductive terminals, and the latch is clamped inside the bayonet, thus realizing docking of the cable connector with the board connector.

In an actual using process, as an operator is not professional, it is easy to cause reverse inserting and mis-inserting when plugging, wherein reverse inserting means that the cable connector rotates 180 degrees to insert into the board connector, and mis-inserting means that the PCB board of the cable connector is inserted forward into a gap between the board connector body and the metal case of the board connector. Reverse inserting and mis-inserting cause failure of electrical connection between the metal contact surface of the PCB board and conductive terminals or easy loosening of electrical contact, thus affecting its use.

SUMMARY

Regarding the technical problems proposed in the background, the first objective of the disclosure is to provide a board connector and a connector assembly for effectively preventing reverse inserting of a cable connector while docking the cable connector with the board connector.

The second objective of the disclosure is to provide a board connector and a connector assembly for directing docking.

The third objective of the disclosure is to provide a board connector and a connector assembly for effectively preventing mis-inserting of a cable connector while docking the cable connector with the board connector.

In order to realize the above objectives, the technical solution of the disclosure is provided as follows:

a board connector comprising a board connector body, conductive terminals of upper and lower rows inserted inside the board connector body and a docking housing wrapped outside the board connector body, wherein a front end of the board connector is used for docking with a cable connector, the docking housing comprises a top wall, a bottom wall and two side walls, a docking slot is provided between the top wall and a top surface of the board connector body, and a bottom of the board connector is provided with a blocking element that protrudes downward.

Preferably, the blocking element is formed by a part of the bottom wall of the docking housing that is bent downward.

Preferably, the blocking element is integrally formed with the docking housing.

Preferably, the blocking element is assembled on the bottom wall of the docking housing.

Preferably, the blocking element is formed by a part of the docking housing that is bent downward.

A notch is provided at a front end of the bottom wall of the docking housing, the blocking element protrudes downward from the notch; or a perforation is provided on the bottom wall of the docking housing, the blocking element protrudes downward from the perforation.

Preferably, there is one the blocking element provided at a middle portion of the bottom wall, or there are two blocking elements symmetrically provided at two sides of the bottom wall, or there are a plurality of blocking elements distributed evenly on the bottom wall.

Preferably, the blocking element is provided at a front end of the bottom wall.

Preferably, an included angle is formed between a protruding direction of the blocking element and a docking direction of the board connector, wherein the included angle is smaller than or equal to 90 degrees.

Preferably, the top wall and a part of a side wall connected to the top wall extend forward to form a lug for directing docking.

Preferably, a front end surface of the lug goes beyond a front end surface of the board connector body; and/or there is a pair of lugs and the docking slot is provided between the pair of lugs.

Preferably, a front end of the top wall is bent downward to form a guiding piece.

Preferably, there is a pair of guiding pieces symmetrically provided at two sides of the top wall; or there is one guiding piece provided at a middle portion of the top wall.

Preferably, a width of the guiding piece is 0.4~1.5 mm and a height of the guiding piece is 0.2~1.3 mm.

The disclosure further provides a connector assembly, comprising a cable connector and the board connector which are inserted to each other for coordination.

Preferably, the cable connector comprises an insulating body, a PCB board provided inside the insulating body, and a cable having one end electrically connected to the PCB board and passing outward through the insulating body, wherein a front end of the PCB board extends forward outside the insulating body and forms an inserting portion, a metal contact sheet is arranged on a surface of the inserting portion, a top of the insulating body protrudes forward to form a docking portion, the docking portion is located above the inserting portion, and a first restriction slot is formed between a bottom surface of the docking portion and a top surface of the inserting portion.

Preferably, when the cable connector is reversely inserted, interference occurs between the blocking element and a front end of the docking portion.

Preferably, a guiding slot is provided on the docking portion along an extending direction of the docking portion, and a front end of the guiding slot communicates to a front end surface of the docking portion.

Preferably, a front end of the top wall of the docking housing is bent downward to form a guiding piece, and the guiding slot is provided at a top of the docking portion and cooperates with the guiding piece.

Preferably, a slot wall of the guiding slot which is perpendicular to a direction that the PCB board extends outward, is located between a slot bottom of the first restriction slot and an end of the metal contact of the PCB board close to the insulating body.

Preferably, a width of the guiding slot is 0.5~2 mm and a height of the guiding slot is 0.3~1.5 mm.

Preferably, there are two pieces of guiding slots and the two pieces of guiding slots are symmetrically provided at two sides of the docking portion, or there is one piece of guiding slot provided at a middle portion of the docking portion.

Preferably, an end surface of an extending end of the docking portion aligns with or goes beyond an end surface of the inserting portion of the PCB board.

Preferably, two sides of the insulating body extend forward to form side fenders, and a second restriction slot is formed between the side fender and the docking portion and/or the inserting portion.

Preferably, an end of the side fender that extends outward aligns with or goes beyond an end surface of the inserting portion of the PCB board.

Preferably, the cable connector further comprises a clip, a mounting slot is provided on a top of the docking portion, and the clip is mounted inside the mounting slot.

Preferably, the shortest distance from the guiding slot to a side portion of the docking portion is greater than 0.5 mm, and the shortest distance from the guiding slot to the clip is greater than 0.5 mm.

Preferably, a distance between the lowest position of a bottom of the guiding piece and a lower surface of the docking slot is smaller than a height of the inserting portion.

The disclosure has the following advantageous effects:

1. A blocking element is provided on a bottom wall of a board connector, and when a cable connector is reversely inserted, interference may occur between the blocking element and a front end of the cable connector, thereby preventing occurrence of a reverse inserting phenomenon.

2. A guiding piece is provided on the board connector. When mis-operation occurs to a user, i.e. when the user intends to insert the inserting portion of the PCB board into the docking slot, the guiding piece generates interference with the inserting portion, such that the inserting portion cannot be inserted into the docking slot, thereby preventing occurrence of a mis-inserting phenomenon.

3. A guiding slot cooperating with the guiding piece is provided on the cable connector, such that a guide and restriction structure is formed while docking the cable connector with the board connector, so as to realize inserting cooperation with the board connector better and reduce risks of PIN collapse.

BRIEF DESCRIPTION OF THE DRAWINGS

The above and other objectives, features and advantages of the disclosure will become more apparent from a more detailed description of exemplary embodiments of the disclosure with combination of the accompanying drawings, wherein the same reference numerals generally refer to the same parts in the exemplary embodiments of the disclosure.

DESCRIPTION OF REFERENCE NUMBERS

1. insulating body; 10. docking portion; 100. guiding slot; 101. first restriction slot; 102. second restriction slot; 103. mounting slot; 11. side fender; 2. PCB board; 20. inserting portion; 3. clip; 4. board connector; 40. docking slot; 400. guiding piece; 401. lug; 402. blocking element; 41. board connector body; 42. conductive terminal; 43. docking housing; 431. top wall; 432. side wall; 433. bottom wall; 5. cable connector.

DESCRIPTION OF THE EMBODIMENTS

Preferred embodiments of the disclosure will be described in more detail below. While the disclosure has been described in terms of the preferred embodiments of the disclosure, it should be understood that the disclosure may be embodied in a variety of forms and should not be limited by the embodiments set forth herein. Rather, these embodiments are provided so that the disclosure will be more thorough and complete, and the scope of the disclosure may be fully conveyed to a person skilled in the art.

The following describes the disclosure further with reference to accompanying drawings and specific implementations.

Embodiment One

Figure 1:
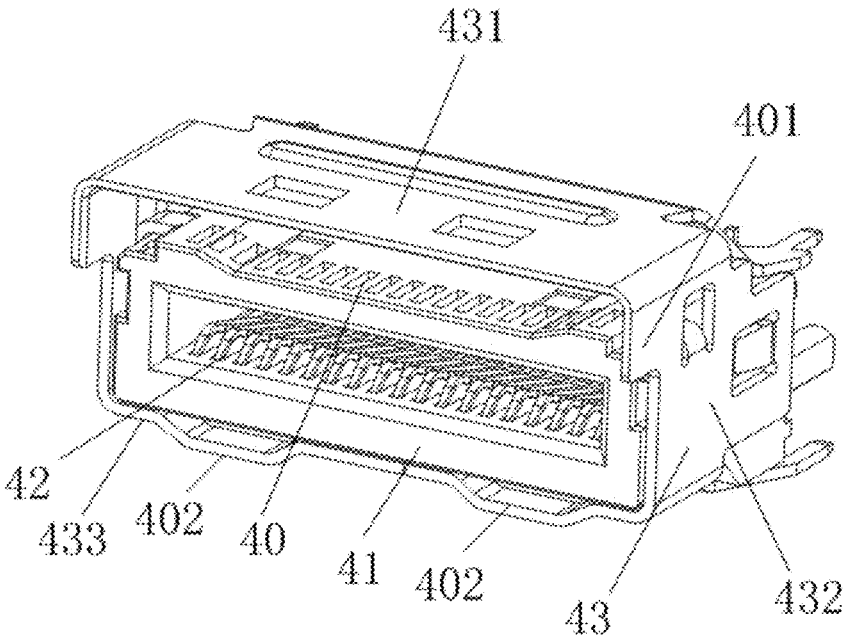
FIG. 1 is a stereo view of a board connector of embodiment one.
Figure 2:
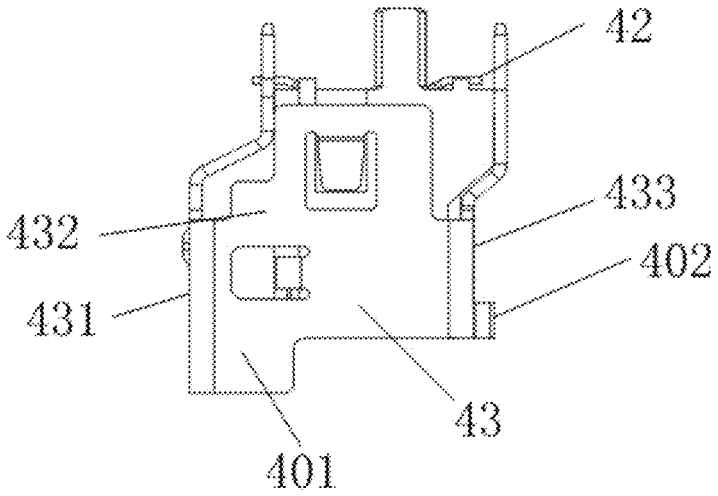
FIG. 2 is a side view of a board connector of embodiment one.

As shown in FIG. 1 and FIG. 2, a board connector 4 comprises a board connector body 41, conductive terminals 42 of upper and lower rows inserted inside the board connector body 41 for contact-cooperation with an inserting portion 20, and a docking housing 43 wrapped outside the board connector body 41. The docking housing 43 comprises a top wall 431, a bottom wall 433 and two side walls 432, a docking slot 40 is provided between the top wall 431 and a top surface of the board connector body 41 for an inserting portion 10 to insert inside, and the bottom wall 433 is provided with a blocking element 402 that protrudes downward.

In the embodiment, the blocking element 402 is formed by a part of the bottom wall 433 of the docking housing 43 that is bent downward, i.e. a form of a bump. In this case, the blocking element 402 can be integrally formed with the docking housing 43. Optionally, the blocking element 402 can also be assembled to the bottom wall 433 of the docking housing 43, such as being connected to the bottom wall 433 through welding or other forms. Optionally, the blocking element 402 is formed by a part of the board connector body 41 that is bent downward. In this case, a front end of the bottom wall 433 of the docking housing 43 is provided with a notch, from which the blocking element 402 protrudes downward, or the bottom wall 433 of the docking housing 43 is provided with a perforation, from which the blocking element 402 protrudes downward. It is also easy for a person skilled in the art to conceive of other manners of forming the blocking element 402.

Preferably, an included angle is formed between a protruding direction of the blocking element 402 and a docking direction of the board connector 4, wherein the included angle is smaller than or equal to 90 degrees.

In the embodiment, there are two blocking elements 402 symmetrically provided at two sides of the bottom wall 433; or there is one blocking element 402 provided at a middle portion of the bottom wall 433; or there are a plurality of blocking elements 402 distributed evenly on the bottom wall 433.

Preferably, the blocking element 402 is provided at a front end of the bottom wall 433.

Preferably, the top wall 431 and a part of a side wall 432 connected to the top wall 431 extend forward to form a lug 401 for directing docking of the connector with the docking portion 10.

Preferably, a front end surface of the lug 401 goes beyond a front end surface of the board connector body 41 to improve a directing effect of docking. There is a pair of lugs 401 and the docking slot 40 is provided between the pair of lugs 401.

When the board connector 4 is docked with the cable connector 5, if mis-operation occurs to a user, that is, the cable connector 5 is reversely inserted, since occurrence occurs between the blocking element 402 and a front end of the cable connector 5, the cable connector 5 can be prevented from being inserted into the board connector 4, thereby preventing occurrence of a reverse inserting phenomenon.

Embodiment Two

Figure 3:
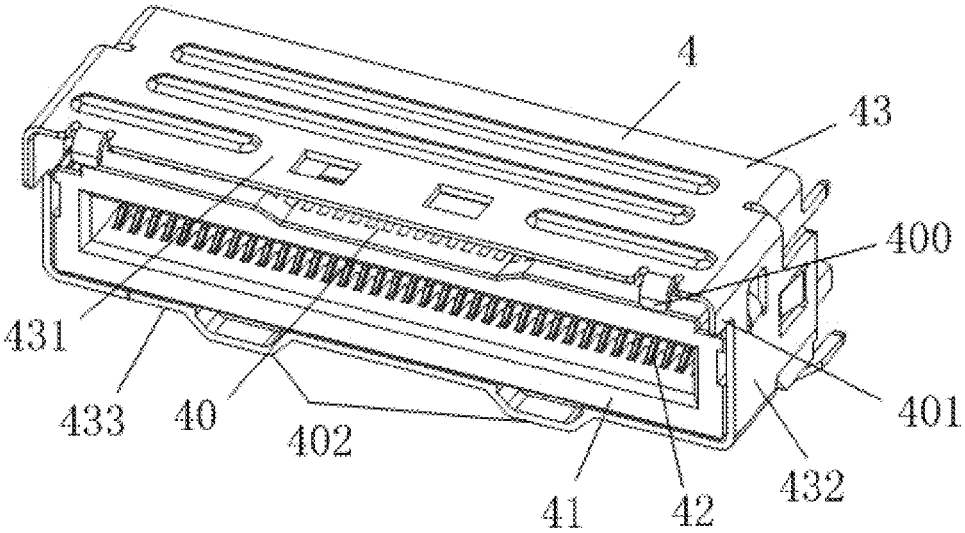
FIG. 3 is a stereo view of a board connector of embodiment two.
Figure 4:
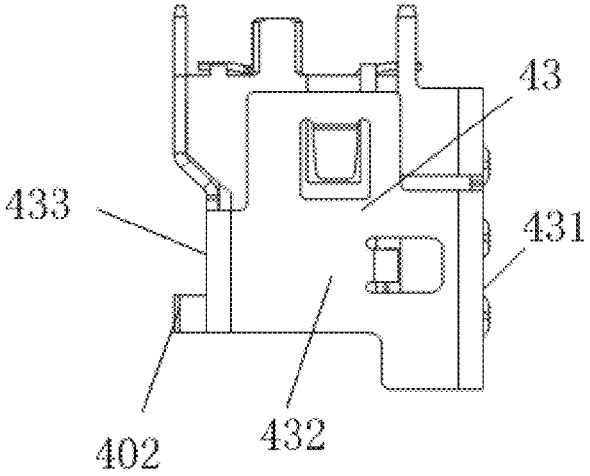
FIG. 4 is a side view of a board connector of embodiment two.
Figure 5:
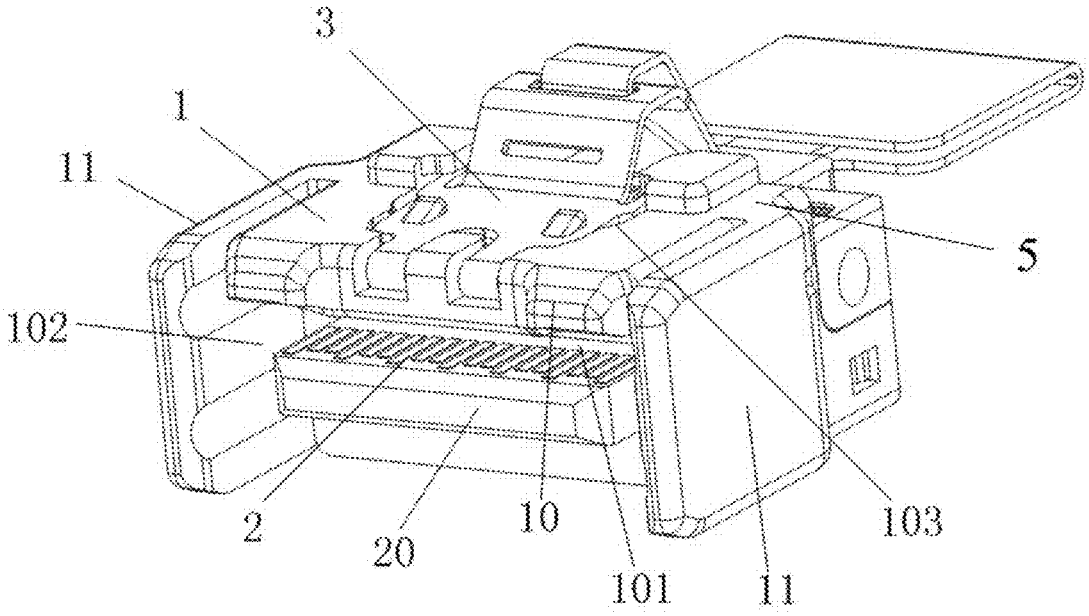
FIG. 5 is a stereo view of a cable connector of embodiment three.
Figure 6:
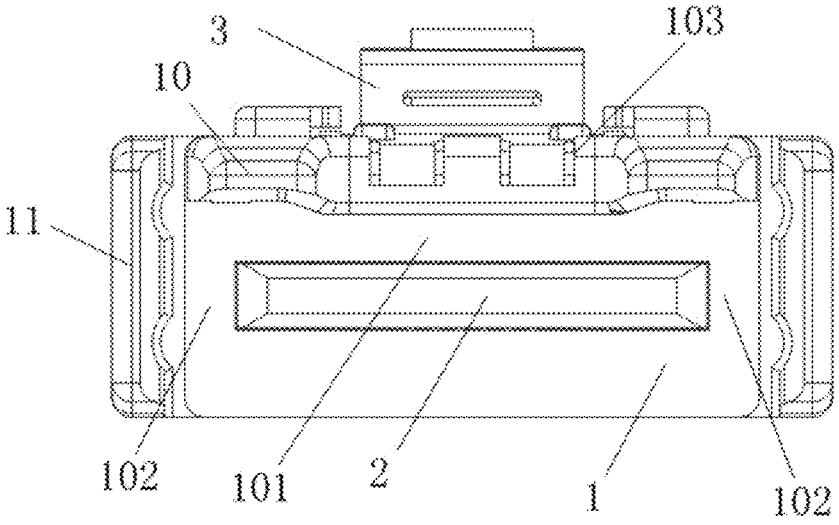
FIG. 6 is a front view of a cable connector of embodiment three.
Figure 7:
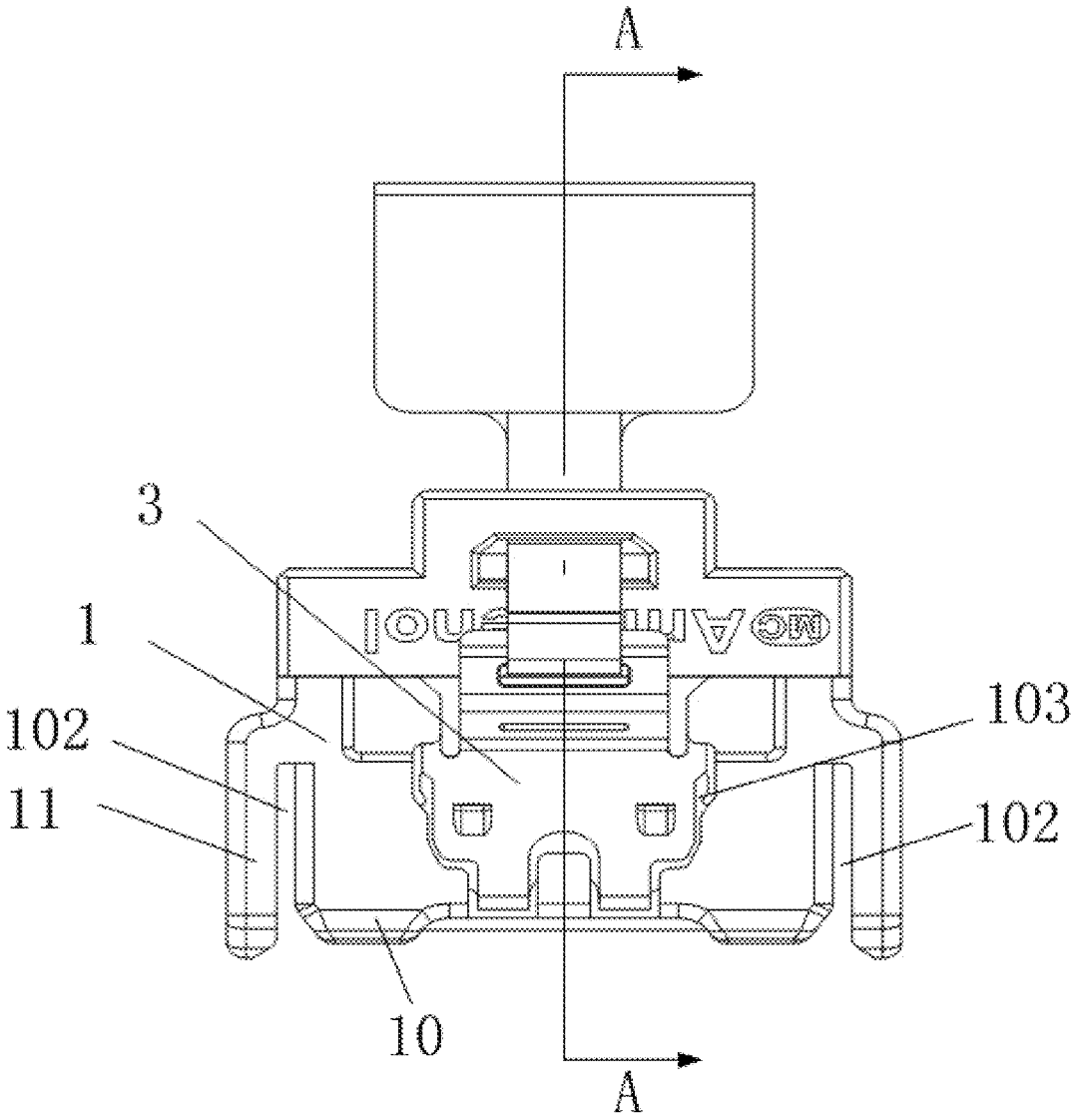
FIG. 7 is a top view of a board connector of embodiment three.
Figure 8:
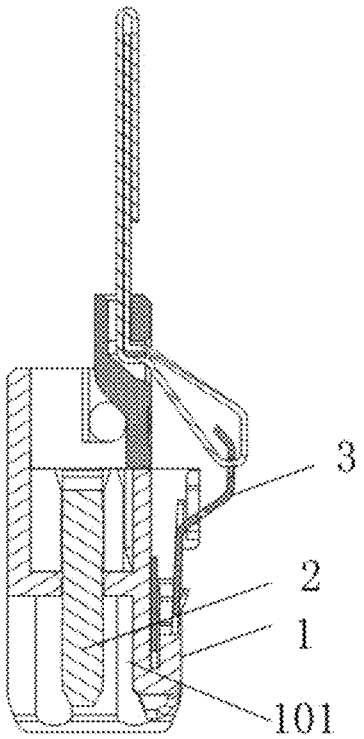
FIG. 8 is a section view along an A-A direction of FIG. 7.

As shown in FIG. 3 and FIG. 4, the embodiment differs from embodiment one only in that a front end of the top wall 431 is bent downward to form a guiding piece 400. A distance H between the lowest position of the bottom of the guiding piece 400 and a lower surface of the docking slot 40 is smaller than a height of the inserting portion 20 of the cable connector 5. Preferably, a width of the guiding piece 400 is 0.4~1.5 mm Preferably, a width of the guiding piece 400 is 0.2~1.3 mm.

In the embodiment, there are two guiding pieces 400 and the two guiding pieces 400 are symmetrically provided at two sides of a front end of the top wall 431. Optionally, there is one guiding piece 400 provided at a middle portion of the top wall 431.

Embodiment Three

As shown in FIG. 5 to FIG. 8, a connector assembly comprises a cable connector 5 and a board connector 4 which are inserted to each other. The board connector is the board connector in embodiment one.

As shown in FIG. 5 to FIG. 8, the cable connector 5 comprises an insulating body 1, a PCB board 2 provided inside the insulating body 1, and a cable having one end electrically connected to the PCB board 2 and passing outward through the insulating body 1 (not shown in the drawing). A front end of the PCB board 2 extends forward outside the insulating body 1 and forms an inserting portion 20, a top of the insulating body 1 protrudes forward to form a docking portion 10, the docking portion 10 is located above the inserting portion 20, and a first restriction slot 101 is formed between a bottom surface of the docking portion 10 and a top surface of the inserting portion 20.

In the embodiment, a length of the docking portion 10 exceeds an extending length of the PCB board 2 thereby protecting the inserting portion 20 of the PCB board 2 from being scraped and damaged. Certainly, in other embodiments, an end surface of an extending end of the docking portion 10 can align with an end surface of the inserting portion 20 of the PCB board 2.

When the cable connector 5 is inserted to the board connector 4, when mis-operation occurs to a user, that is, the cable connector 5 is reversely inserted, since occurrence occurs between the blocking element 402 and a front end of the cable connector 5, the cable connector 5 can be prevented from being inserted into the board connector 4, thereby preventing occurrence of a reverse inserting phenomenon.

Further, in order to strengthen protection for the docking housing 40 of the board connector 4 and improve docking stability, reliability and convenience, the insulating body 1 extends outward with a side fender 11, the side fender 11 is provided at a side portion of the docking portion 10 and the PCB board 2, and the side fender 11 is provided at an interval with a side end surfaces of the docking portion 10 and the PCB board 2, and a second restriction slot 102 is formed between the side fender 11 and the side end surfaces of the docking portion 10 and the PCB board 2. In the embodiment, there are two pieces of side fenders 11 symmetrically provided at two sides of the insulating body 1. Moreover, an end of the side fender 11 that extends outward aligns with an end surface of the inserting portion 20 of the PCB board 2.

After the cable connector 5 and the board connector 4 are docked for mounting, the housing of the board connector 4 is clamped into the second restriction slot 102 and the side fender 11 protects the outer side of the docking housing of the board connector 4.

Preferably, in order to facilitate inserting cooperation with the board connector 4, the above cable connector 5 further comprises a clip 3, a top of the docking portion 10 is provided with a mounting slot 103 and the clip 3 is mounted inside the mounting slot 103.

Correct inserting and reverse inserting are further interrupted as follows by combining the diagrams.

Figure 9:
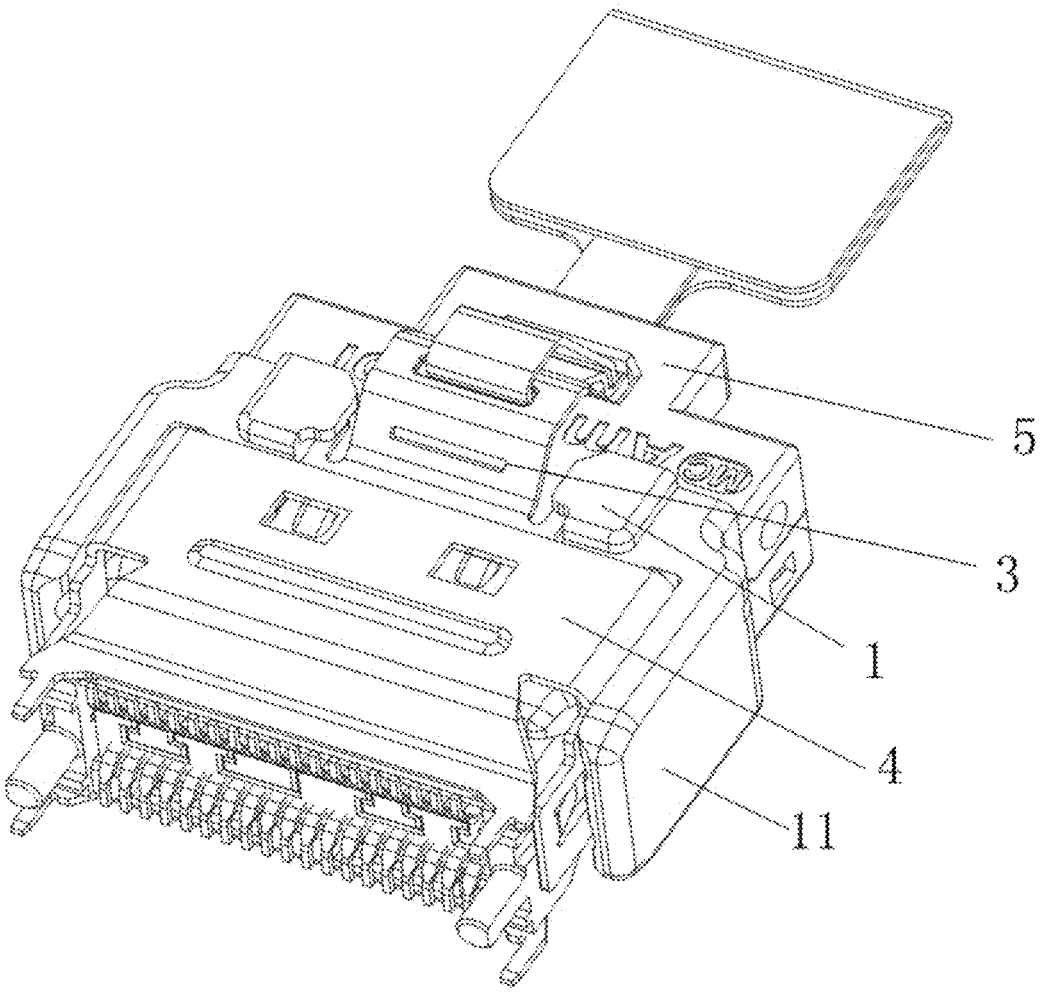
FIG. 9 is an inserting stereo view of a cable connector and a board connector of embodiment three (correct inserting)
Figure 10:
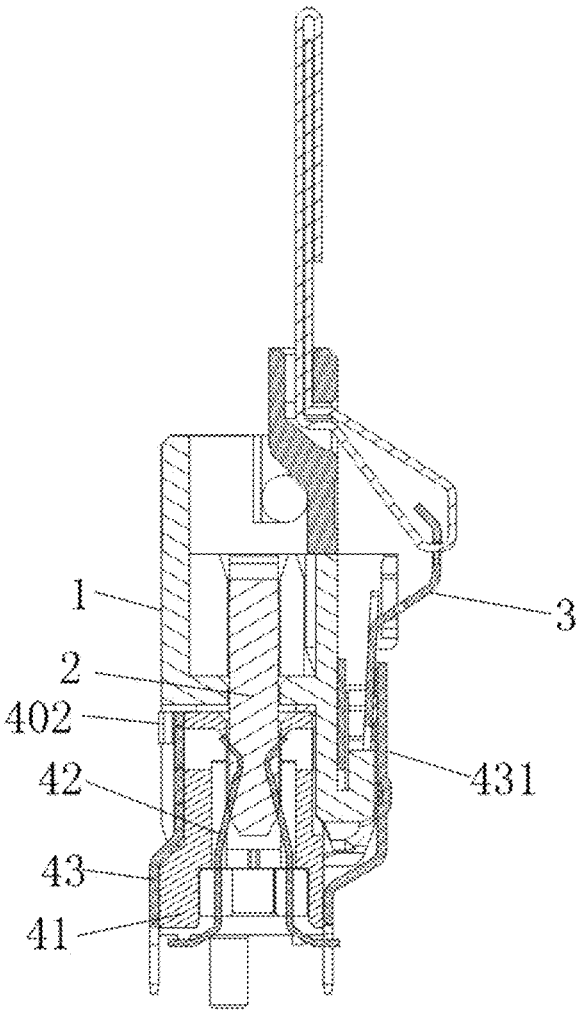
FIG. 10 is an inserting section view of a cable connector and a board connector of embodiment three (correct inserting)

Please refer to FIG. 9 and FIG. 10, for correct inserting, the PCB board 2 is inserted into the board connector body 41 and the docking portion 10 is inserted into the docking slot 40.

Figure 11:
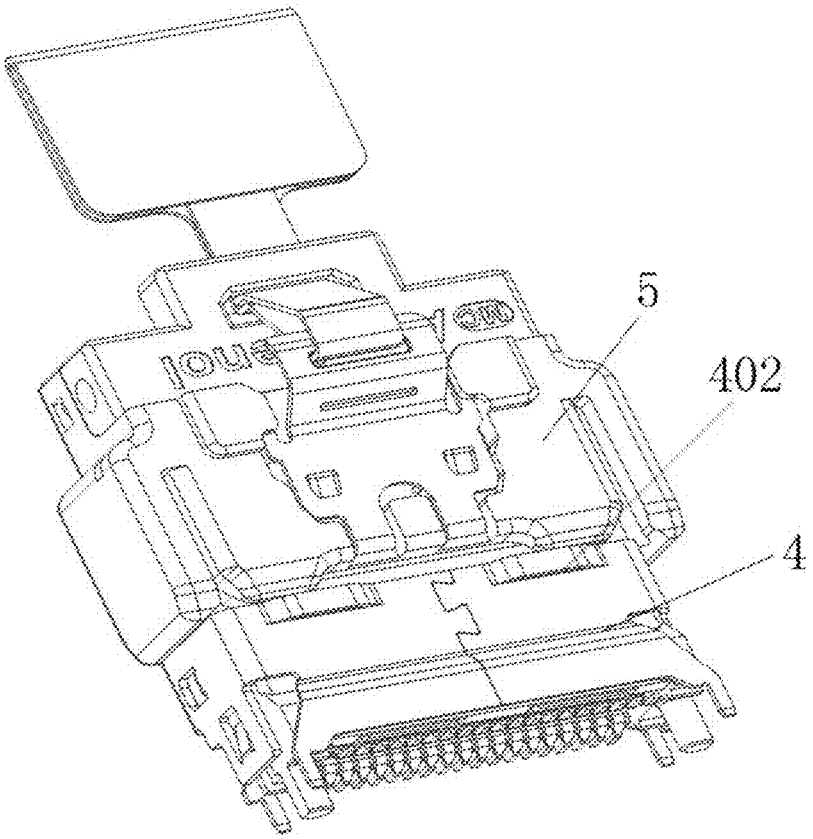
FIG. 11 is an inserting stereo view of a cable connector and a board connector of embodiment three (reverse inserting)
Figure 12:
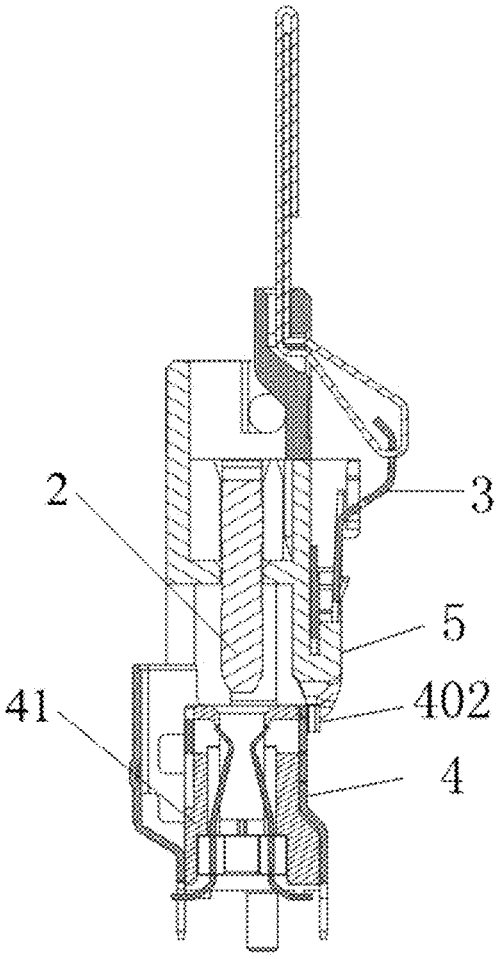
FIG. 12 is n inserting section view of a cable connector and a board connector of embodiment three (reverse inserting)

Please refer to FIG. 11 and FIG. 12, for reverse inserting, the PCB board 2 is aligned with the board connector body 41. However, the blocking element 402 abuts against a front end of the cable connector 5 to prevent the cable connector 5 from being inserted into the board connector 4, thereby preventing occurrence of a reverse inserting phenomenon.

Embodiment 4

A connector assembly comprises a cable connector 5 and a board connector 4 which are inserted to each other for cooperation. The board connector is the board connector in embodiment two.

Figure 13:
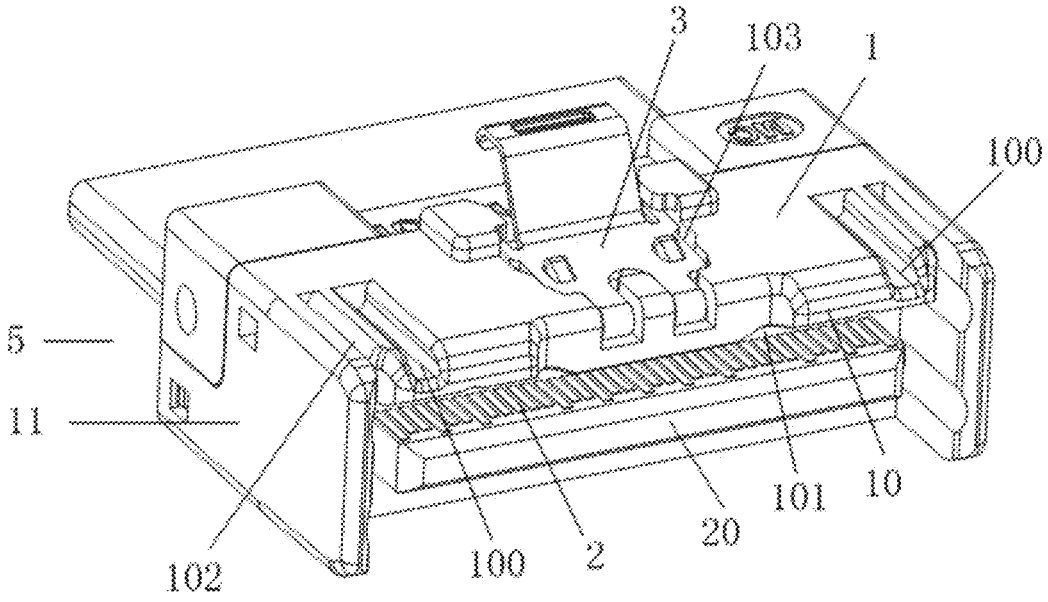
FIG. 13 is a stereo view of a cable connector of embodiment four.
Figure 14:
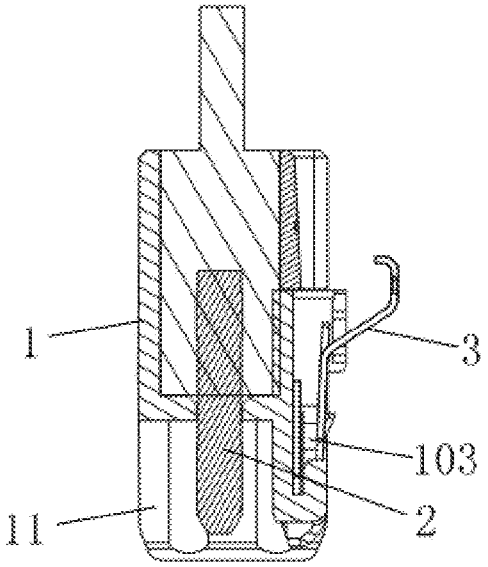
FIG. 14 is a section view of a cable connector of embodiment four.

As shown in FIG. 13 and FIG. 14, the cable connector 4 in the embodiment differs from embodiment three in that: one or more pieces of guiding slots 100 are provided on a top of the docking portion 10 along an extending direction of the docking portion 10, and a front end of the guiding slot 100 communicates to a front end surface of the docking portion 10. Preferably, the docking portion 10 goes forward beyond a front end surface of the inserting portion 20. Preferably, a width of the guiding slot 100 is 0.5~2 mm Preferably, a depth of the guiding slot 100 is 0.3~1.5 mm.

In the embodiment, there are two pieces of guiding slots 100 and the two pieces of guiding slots 100 are respectively provided at two sides of the clip 3. Preferably, the shortest distance from the guiding slot 100 to a side portion of the docking portion 100 is greater than 0.5 mm, and the shortest distance from the guiding slot 100 to the clip 3 is greater than 0.5 mm.

Preferably, a distance H between the lowest position of the bottom of the guiding piece 400 and a lower surface of the docking slot 40 is smaller than a height of the inserting portion 20.

Figure 15:
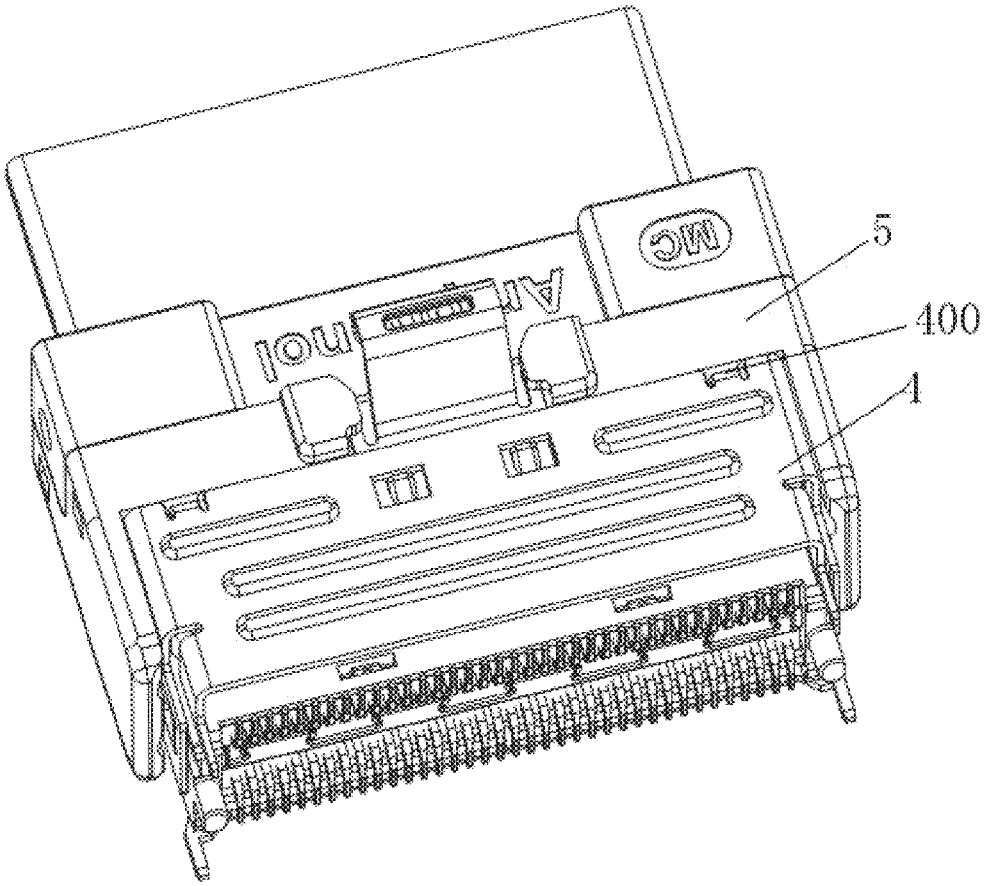
FIG. 15 is an inserting stereo view of a cable connector and a board connector of embodiment four (correct inserting)
Figure 16:
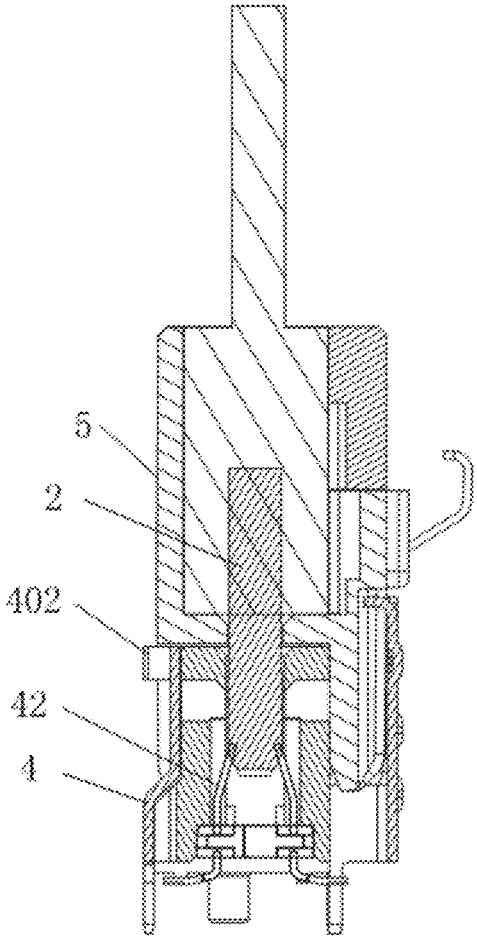
FIG. 16 is an inserting section view of a cable connector and a board connector of embodiment four (correct inserting)
Figure 17:
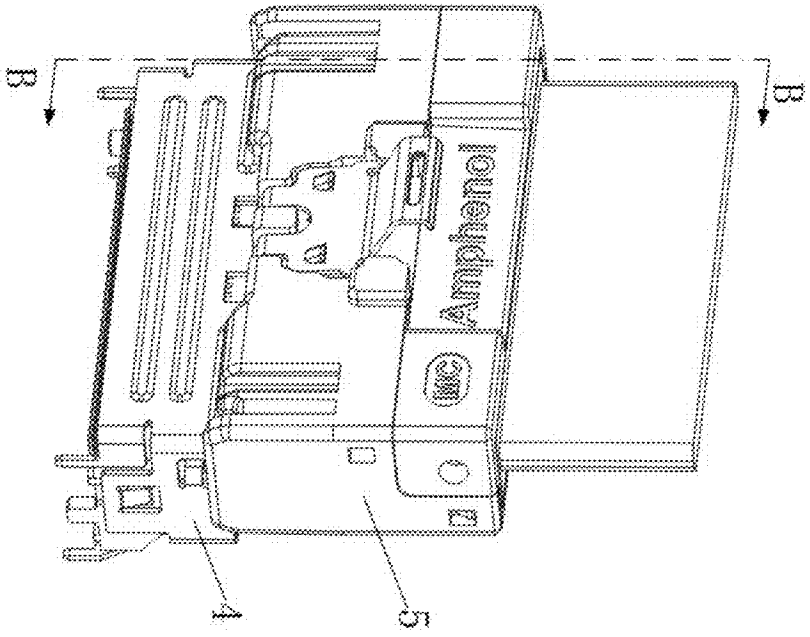
FIG. 17 is an inserting stereo view of a cable connector and a board connector of embodiment four (mis-inserting)
Figure 18:
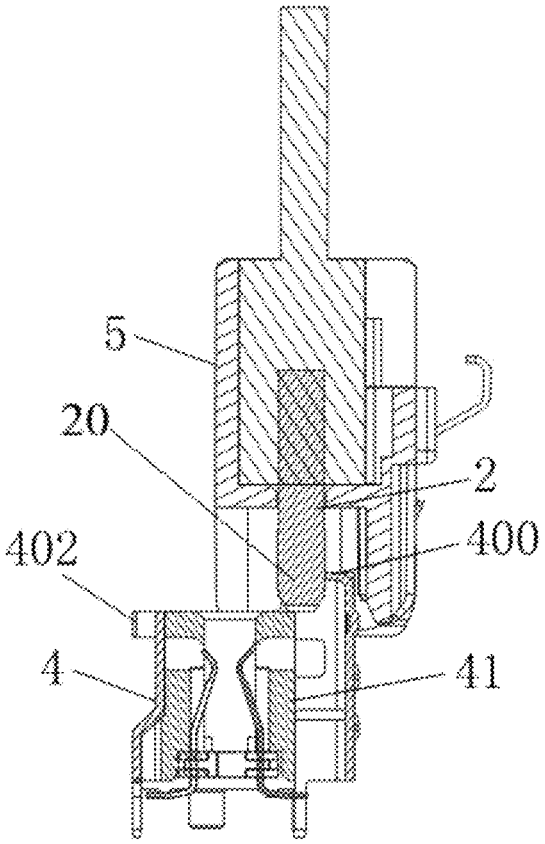
FIG. 18 is a section view along a B-B direction of FIG. 17 (mis-inserting).

FIG. 15 and FIG. 16 show an inserting cooperation diagram of a cable connector 5 and a board connector 4 in embodiment four, and the specific docking process involves: under a guiding effect of the guiding piece 400 and the guiding slot 100, the docking portion 10 of the cable connector 5 is inserted forward into the docking slot 40 of the board connector 4 until the inserting portion 20 of the PCB board 2 is clamped between conductive terminals 42, and a metal contact sheet on the inserting portion 20 is electrically connected to the conductive terminals 42. When mis-operation occurs to a user, i.e. when the user intends to insert the inserting portion 20 of the PCB board 2 into the docking slot 40, since a distance H between the lowest position of the bottom of the guiding piece 400 and a lower surface of the docking slot 40 is smaller than a height of the inserting portion 20, the guiding piece 400 thus generates interference with the inserting portion 20, such that the inserting portion 20 cannot be inserted into the docking slot 40, thereby preventing occurrence of a mis-inserting phenomenon, as shown in FIG. 17 and FIG. 18.

The embodiments of the disclosure have been described above, and the foregoing description is illustrative, not limiting, and not limited to the disclosed embodiments. Numerous modifications and changes will be apparent to a person of ordinary skill in the art without departing from the scope and spirit of the illustrated embodiments.

What is claimed is:

1. A connector assembly, comprising:

a cable connector; and a board connector;

the cable connector and the board connector being inserted to each other;

wherein the board connector comprises a board connector body, conductive terminals of upper and lower rows inserted inside the board connector body and a docking housing wrapped outside the board connector body, wherein a front end of the board connector is used for docking with a cable connector, the docking housing comprises a top wall, a bottom wall and two side walls, a docking slot is provided between the top wall and a top surface of the board connector body, and a bottom of the board connector is provided with a blocking element that protrudes downward;

wherein the cable connector comprises an insulating body, a PCB board provided inside the insulating body, and a cable having one end electrically connected to the PCB board and passing outward through the insulating body, wherein a front end of the PCB board extends forward outside the insulating body and forms an inserting portion, a metal contact sheet is arranged on a surface of the inserting portion, a top of the insulating body protrudes forward to form a docking portion, the docking portion is located above the inserting portion, and a first restriction slot is formed between a bottom surface of the docking portion and a top surface of the inserting portion;

wherein when the cable connector is reversely inserted, interference occurs between the blocking element and a front end of the docking portion.

2. The connector assembly according to claim 1, characterized in that the blocking element is formed by a part of the bottom wall of the docking housing that is bent downward.

3. The connector assembly according to claim 2, characterized in that the blocking element is integrally formed with the docking housing.

4. The connector assembly according to claim 1, characterized in that the blocking element is assembled to the bottom wall of the docking housing.

5. The connector assembly according to claim 1, characterized in that the blocking element is formed by a part of the board connector body that protrudes downward;

a notch is provided at a front end of the bottom wall of the docking housing, the blocking element protrudes downward from the notch; or a perforation is provided on the bottom wall of the docking housing, the blocking element protrudes downward from the perforation.

6. The connector assembly according to claim 1, characterized in that there is one blocking element provided at a middle portion of the bottom wall, or there are two blocking elements symmetrically provided at two sides of the bottom wall, or there are a plurality of blocking elements distributed evenly on the bottom wall.

7. The connector assembly according to claim 1, characterized in that the blocking element is provided at a front end of the bottom wall.

8. The connector assembly according to claim 1, characterized in that an included angle is formed between a protruding direction of the blocking element and a docking direction of the board connector, wherein the included angle is smaller than or equal to 90 degrees.

9. The connector assembly according to claim 1, characterized in that the top wall and a part of a side wall connected to the top wall extend forward to form a lug for directing docking.

10. The connector assembly according to claim 9, characterized in that a front end surface of the lug goes beyond a front end surface of the board connector body; and/or there is a pair of lugs and the docking slot is provided between the pair of lugs.

11. The connector assembly according to claim 1, characterized in that a front end of the top wall is bent downward to form a guiding piece.

12. The connector assembly according to claim 11, characterized in that there is a pair of guiding pieces symmetrically provided at two sides of the top wall; or there is one guiding piece provided at a middle portion of the top wall;

a width of the guiding piece is 0.4~1.5 mm and a height of the guiding piece is 0.2~1.3 mm.

13. The connector assembly according to claim 1, characterized in that a guiding slot is provided on the docking portion along an extending direction of the docking portion, and a front end of the guiding slot communicates to a front end surface of the docking portion.

14. The connector assembly according to claim 13, characterized in that there are two pieces of guiding slots and the two pieces of guiding slots are symmetrically provided at two sides of the docking portion, or there is one piece of guiding slot provided at a middle portion of the docking portion.

15. The connector assembly according to claim 1, characterized in that two sides of the insulating body extend forward to form side fenders, and a second restriction slot is formed between the side fender and the docking portion and/or the inserting portion; and/or the cable connector further comprises a clip, a mounting slot is provided on a top of the docking portion, and the clip is mounted inside the mounting slot.

16. A connector assembly, comprising:

a cable connector; and a board connector;

the cable connector and the board connector being inserted to each other;

wherein the board connector comprises a board connector body, conductive terminals of upper and lower rows inserted inside the board connector body and a docking housing wrapped outside the board connector body, wherein a front end of the board connector is used for docking with a cable connector, the docking housing comprises a top wall, a bottom wall and two side walls, a docking slot is provided between the top wall and a top surface of the board connector body, and a bottom of the board connector is provided with a blocking element that protrudes downward;

wherein the cable connector comprises an insulating body, a PCB board provided inside the insulating body, and a cable having one end electrically connected to the PCB board and passing outward through the insulating body, wherein a front end of the PCB board extends forward outside the insulating body and forms an inserting portion, a metal contact sheet is arranged on a surface of the inserting portion, a top of the insulating body protrudes forward to form a docking portion, the docking portion is located above the inserting portion, and a first restriction slot is formed between a bottom surface of the docking portion and a top surface of the inserting portion;

wherein a guiding slot is provided on the docking portion along an extending direction of the docking portion, and a front end of the guiding slot communicates to a front end surface of the docking portion;

wherein a front end of the top wall of the docking housing is bent downward to form a guiding piece, and the guiding slot is provided at a top of the docking portion and cooperates with the guiding piece.

17. A connector assembly, comprising:

a cable connector; and a board connector;

the cable connector and the board connector being inserted to each other;

wherein the board connector comprises a board connector body, conductive terminals of upper and lower rows inserted inside the board connector body and a docking housing wrapped outside the board connector body, wherein a front end of the board connector is used for docking with a cable connector, the docking housing comprises a top wall, a bottom wall and two side walls, a docking slot is provided between the top wall and a top surface of the board connector body, and a bottom of the board connector is provided with a blocking element that protrudes downward;

wherein the cable connector comprises an insulating body, a PCB board provided inside the insulating body, and a cable having one end electrically connected to the PCB board and passing outward through the insulating body, wherein a front end of the PCB board extends forward outside the insulating body and forms an inserting portion, a metal contact sheet is arranged on a surface of the inserting portion, a top of the insulating body protrudes forward to form a docking portion, the docking portion is located above the inserting portion, and a first restriction slot is formed between a bottom surface of the docking portion and a top surface of the inserting portion;

wherein a guiding slot is provided on the docking portion along an extending direction of the docking portion, and a front end of the guiding slot communicates to a front end surface of the docking portion;

wherein a width of the guiding slot is 0.5~2 mm and a height of the guiding slot is 0.3~1.5 mm.

* * * * *